US005195440A

United States Patent [19]

Gottlieb

[11] Patent Number: 5,195,440

[45] Date of Patent: Mar. 23, 1993

[54] PALLET FABRICATED OF STILL FOLDABLE MATERIAL

[75] Inventor: Norman J. Gottlieb, Thornhill, Canada

[73] Assignee: Container Corporation International Inc., Bridgetown, Barbados

[21] Appl. No.: 787,623

[22] Filed: Nov. 4, 1991

Related U.S. Application Data

[63] Continuation-in-part of Ser. No. 767,687, Sep. 30, 1991, abandoned.

[51] Int. Cl.[5] ..... B65D 19/00

[52] U.S. Cl. ..... 108/51.3; 108/56.3

[58] Field of Search ..... 108/51.3, 56.3, 56.1, 108/51.1

[56] References Cited

U.S. PATENT DOCUMENTS

| | | | |
|---|---|---|---|
| 3,006,590 | 10/1961 | Hoag | 108/51.3 |
| 3,026,015 | 3/1962 | Severn | 108/51.3 X |
| 3,026,078 | 3/1962 | Simkins | 108/51.3 |
| 3,131,656 | 5/1964 | Houlle | 108/51.3 |
| 3,165,078 | 1/1965 | White | 108/51.3 |
| 3,308,772 | 3/1967 | Thomas, Jr. | 108/56.3 X |
| 4,759,295 | 7/1988 | Nilson et al. | 108/51.3 |
| 4,863,024 | 9/1989 | Booth | 108/51.3 X |

FOREIGN PATENT DOCUMENTS

| | | | |
|---|---|---|---|
| 62865 | 10/1961 | Canada | 108/51.3 |
| 2319051 | 10/1974 | Fed. Rep. of Germany | 108/51.3 |
| 1311981 | 11/1962 | France | 108/51.3 |
| 457272 | 7/1968 | Switzerland | 108/51.3 |
| 955035 | 4/1964 | United Kingdom | 108/51.3 |

*Primary Examiner*—José V. Chen

*Attorney, Agent, or Firm*—Fetherstonhaugh & Co.

[57] ABSTRACT

A lightweight pallet is provided which includes interconnected platform and channel stringer structure. The interconnection of the structures including various slits, slots, and tabs at various locations on the platform and stringer members. Reinforcement members may be received in the channels.

17 Claims, 7 Drawing Sheets

PALLET FABRICATED OF STILL FOLDABLE MATERIAL

This is a continuation-in-part of U.S. patent application Ser. No. 07/767,687 filed Sep. 30, 1991 now abandoned.

FIELD OF THE INVENTION

This invention relates to a pallet and more particularly to a pallet made of stiff, foldable sheet material such as corrugated cardboard.

BACKGROUND OF THE INVENTION

Lightweight pallets made of corrugated cardboard are known, as disclosed for example in Joachim G. Scmidtke U.S. Pat. No. 4,792,325 issued Dec. 20, 1988, Robert J. Quasnick U.S. Pat. No. 4,867,074 issued Sep. 19, 1989 and Daniel A. Smith U.S. Pat. No. 5,001,991 issued Mar. 26, 1991. Each of these three references discloses a corrugated cardboard pallet having intersecting stringers and runners forming a platform, both the stringers and runners being separately constructed of multi-layered panels. Such pallets are relatively expensive to fabricate.

It is an object of the present invention to provide a lightweight pallet of simple construction which is inexpensive to fabricate.

SUMMARY OF THE INVENTION

The present invention provides a pallet comprising a first rectangular sheet of stiff, foldable material having opposed side and end edges and having a central portion and opposed side edge portions. The central portion has a top and bottom surface and the side edge portions are folded into a plurality of parallel panels to form rectangular first and second channel members beneath the bottom surface of the central portion forming a platform. The outermost panels of the sheet are provided with transverse slits such that each of the outermost panels has at least one first tab and at least one second tab. The central portion has a plurality of first slots located in two spaced rows, the first slots being suitable to receive the first tabs. The at least one first tab of each outer panel are inserted through the first slots of one of said rows of first slots and folded to overlay a portion of the central portion top surface of the first sheet and are secured thereto. The at least one second tab of each outermost panel is folded to underlay the bottom surface of the central portion is being secured thereto. The at least one first and at least one second tab of the outermost panels forms an array of tabs alternately overlaying and underlaying the central portion respectively. There is also provided at least one second rectangular sheet of stiff, foldable material folded into a plurality of parallel panels to form at least a third rectangular channel member with the outermost panels extending laterally from said at least a third rectangular channel member and being provided with transverse slits to provide a plurality of third tabs. The central portion of the first sheet has a plurality of second slots located between the two rows of the first slots to receive the third tabs. The third tabs are inserted through the second slots of the first sheet and folded to overlay a portion of the central portion of the first sheet and are secured thereto. The channel members are for receiving vertical reinforcement means.

The pallet may be reinforced by providing a plurality of crossbraces, each crossbrace comprising a rectangular sheet of stiff material folded into a plurality of panels lying face to face, channel members each having apertures adjacent the platform forming lateral passages to receive the crossbraces.

BRIEF DESCRIPTION OF THE DRAWINGS

An example embodiment of the invention is shown in the accompanying drawings in which.

DETAILED DESCRIPTION OF PREFERRED EMBODIMENT

Figure 1:
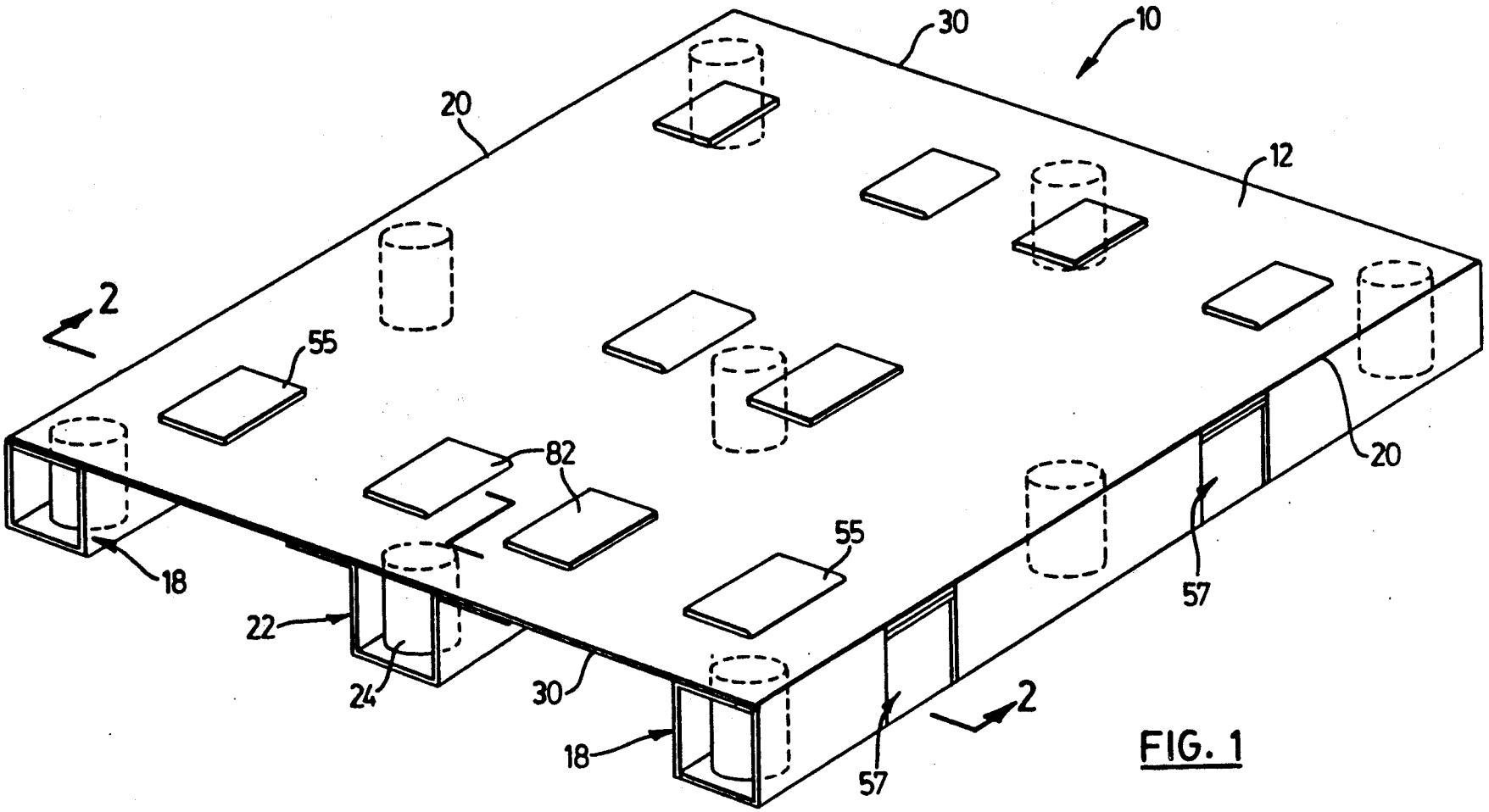
FIG. 1 is perspective view of a pallet.
Figure 2:
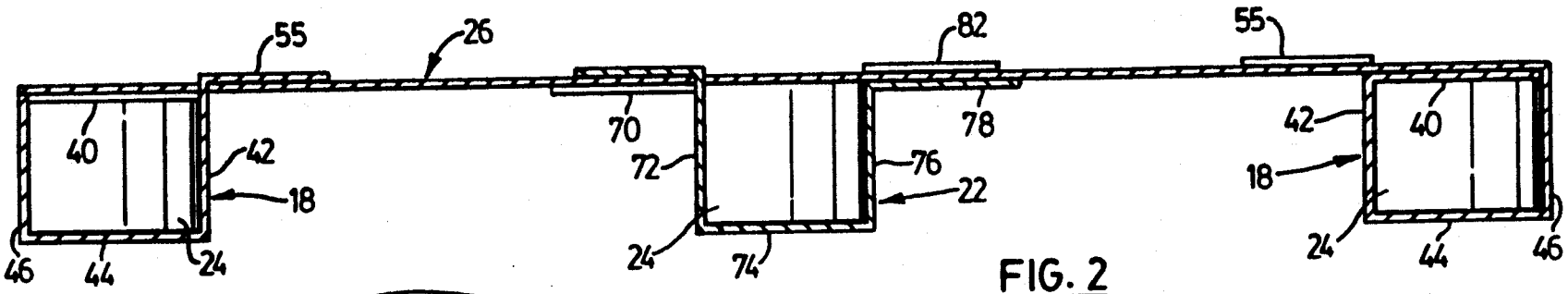
FIG. 2 a cross-sectional view taken along line 2—2 of FIG. 1.

The example embodiment shown in the drawings consists of a pallet 10 of rectangular configuration having a deck or platform 12, first and second parallel channel members or stringers 18 located on the underside of the platform along two opposed side edges 20 of the platform, and a third channel member 22 centrally located on the underside of the platform parallel to channel members 18. Each channel member 18 and 22 is rectangular in cross-section and contains a plurality of spaced reinforcing members 24 extending the height thereof for vertical support.

Figure 5:
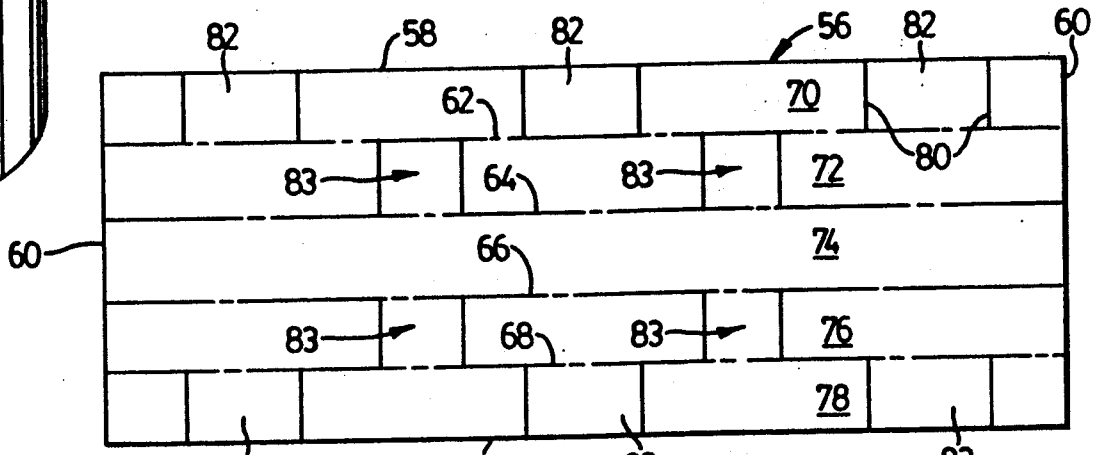
FIG. 5 is a plan view of a sheet of material foldable to form the central support of the pallet of FIG. 1.
Figure 4:
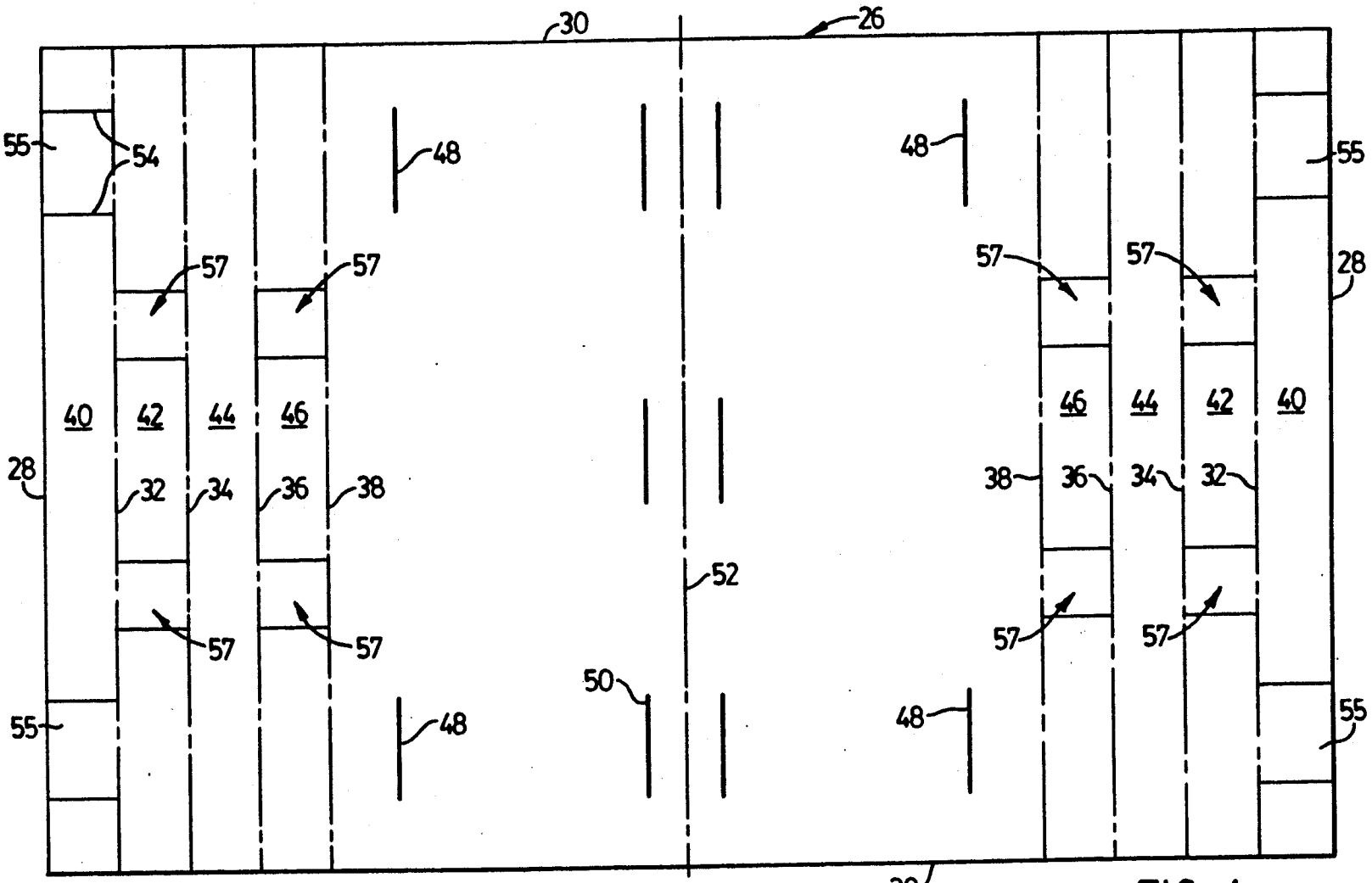
FIG. 4 is a plan view of a sheet of material foldable to form the basic structure of the pallet of FIG. 1.

The construction of pallet 10 uses a first sheet 26 of stiff, foldable material slit and slotted as shown in FIG. 5 of the drawings. Sheet 26 is rectangular with opposed pairs of side edges 28, and opposed pairs of end edges 30. Four fold lines 32, 34, 36 and 38, adjacent each side edge 28 and parallel thereto, delineate panels 40, 42, 44 and 46 respectively, of equal width. Two rows of slots 48, each spaced inwardly from opposed end edges 30 of sheet 26, are located along lines parallel to fold lines 38 and spaced inwardly therefrom a distance equal to the width of panel 44. Two rows of slots 50 are located one on each side of centreline 52 of sheet 26. Each outermost panel 40 has pairs of slits 54 which extend inwardly from its side edge 28 to form tabs 55 foldable along line 32, the location of tabs 55 between end edges 30 corresponding to the location of slots 48 between the end edges. Rectangular pairs of apertures 57 are located in each of panels 42 and 46 of sheet 26 approximately one-third the length of the panels from each side edge 28 of the sheet, extending between fold lines 32,34 and 36,38 respectively.

A second rectangular sheet 56 of stiff, foldable material, used to form a central channel member 22, has a pair of opposed side edges 58 and a pair of opposed end edges 60. Four fold lines 62, 64, 66 and 68, parallel to side edges 58, delineate five panels 70, 72, 74, 76 and 78 of equal width. Pairs of slits 80 in outermost panels 70 and 78 extend inwardly from each side edge 58 of sheet 56 and terminate at the first fold line 62 and 68 respectively to form tabs 82 foldable along lines 62 and 68. The location of tabs 82 between end edges 60 corresponds to the location of slots 50 between end edges 30 of sheet 26. Rectangular apertures 83 are located in each of panels 72 and 76 of sheet 56 the same distance from end edges 60 as the distance of apertures 57 from side edges 28.

Pallet 10 is fabricated by folding each side 28 of sheet 26 on fold lines 32, 34, 36 and 38 as seen in FIG. 5 to form panels 42, 44 and 46 constituting first and second channel members 18. Before the folding procedure is commenced, reinforcing members 24 are attached at one end to panels 44 of sheet 26. In the example embodiment reinforcing members 24 are tubular cores. When panel 40 is folded along line 32, tabs 55 are left unfolded and when that panel is brought around to lie against the underside of sheet 26 the tabs are inserted through slots 48, folded down in the opposite direction to panel 40 to lie against the upper side of sheet 26, and secured to the sheet. When channel members 18 are formed, reinforcing members 24 abut panels 40.

Third channel member 22 is formed by folding sheet 56 along lines 64 and 66 to form panels 72, 74, and 76. Sheet 56 is also folded along lines 62 and 68 to form panels 70 and 78 extending laterally outward from the channel with tabs 82 extending upwardly. Reinforcing members 24 are attached at one end to panel 76. Tabs 82 are inserted through slots 50 in sheet 26 and folded down onto the upper side of the sheet. Panels 70 and 78 and tabs 82 are then fixed to sheet 26. Reinforcing members 24 abut sheet 26. Also, apertures 83 in channel member 22 are in alignment with aperture 57 in channel members 18 to form a pair of lateral passages extending through all channel members 18 and 22 normal thereto.

Preferably the material of sheets 26 and 56 is corrugated cardboard of suitable type and quality to provide the strength required to bear the load for which the pallet is to be used. Tabs 55 and 82, and also panels 40, 70 and 78, are preferably secured by glue to sheet 26.

Figure 6:
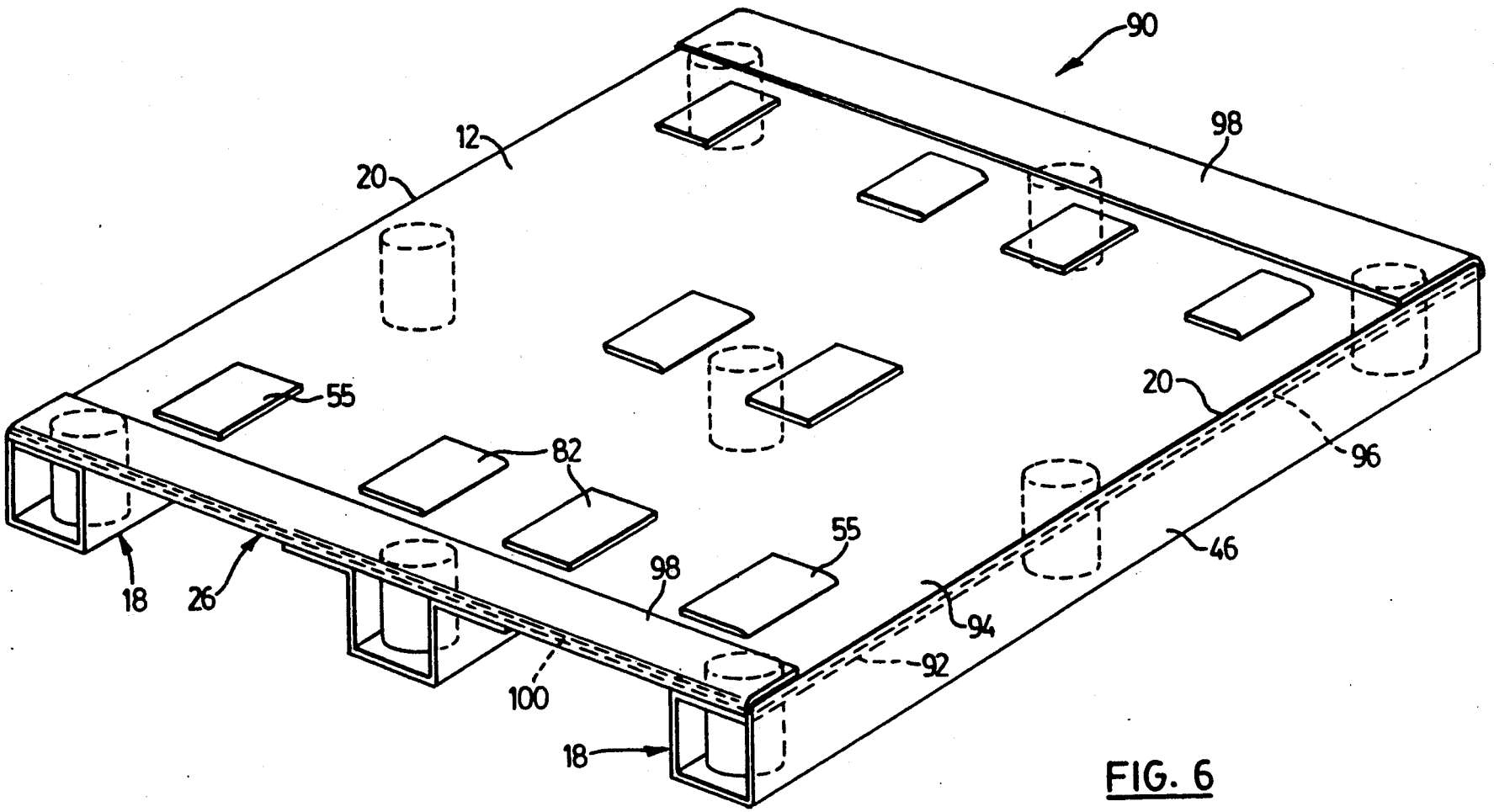
FIG. 6 is a perspective view of a first alternate embodiment of the pallet of FIG. 1.

The first alternate embodiment of the invention shown in FIG. 6 consists of a pallet 90 similar to the pallet of FIG. 1 except that sheet 26 is laminar having an upper lamina 92 and a lower lamina 94. The side edge portions of upper lamina 92 are folded to form channel members 18. The side edges 96 of lower lamina 94 terminate at panels 46 and the end edge portions 98 extend beyond end edges 100 of the upper lamina and are folded up and back over the upper lamina and secured thereto. This provides added strength to the pallet. Also when the pallet is made of corrugated cardboard further strength is obtained by having the corrugations of lamina 92 run perpendicular to the corrugations of the lamina 94 of sheet 26.

Figure 7:
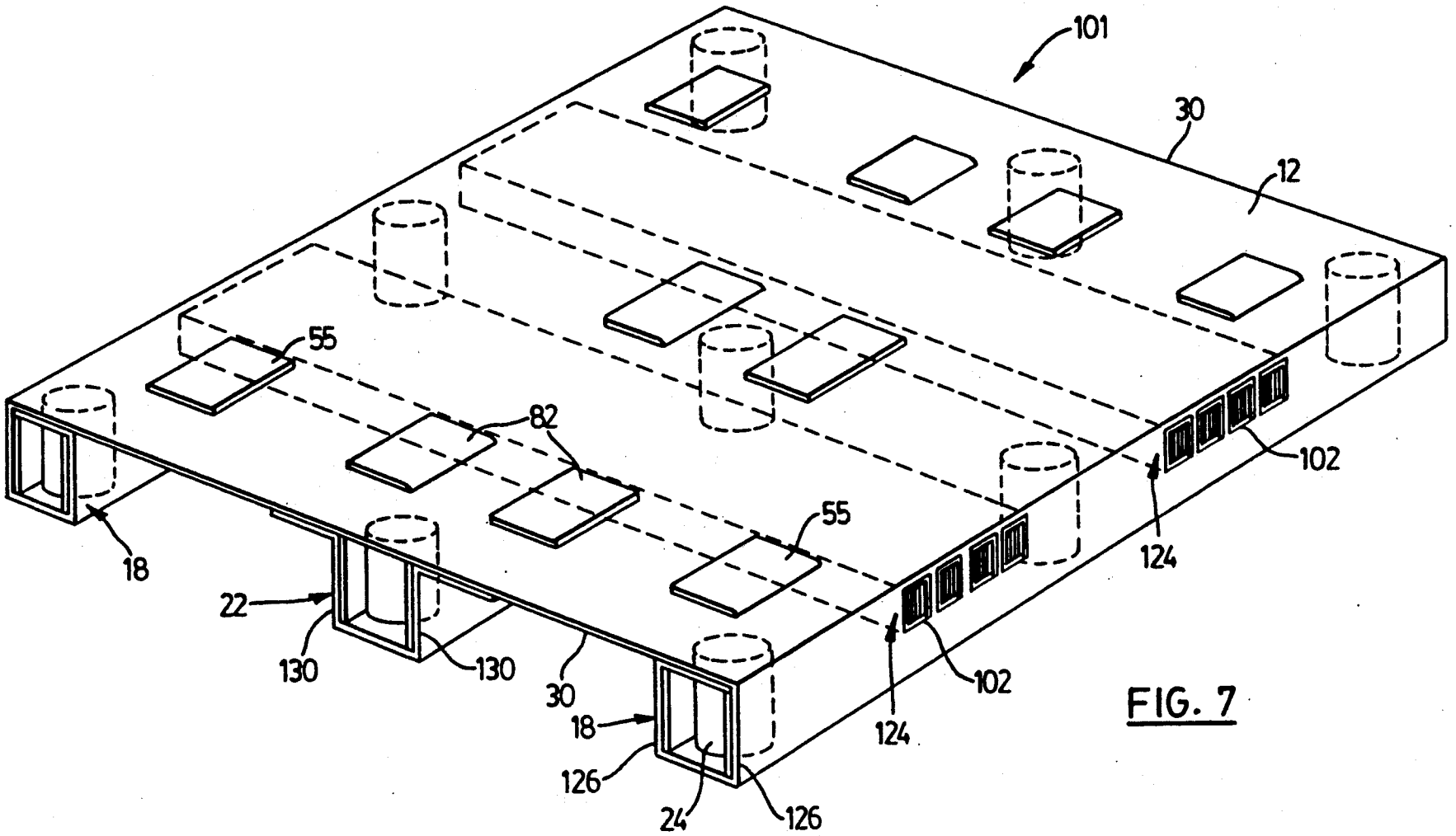
FIG. 7 is a perspective view of a second alternate embodiment of the pallet of FIG. 1.
Figure 8:
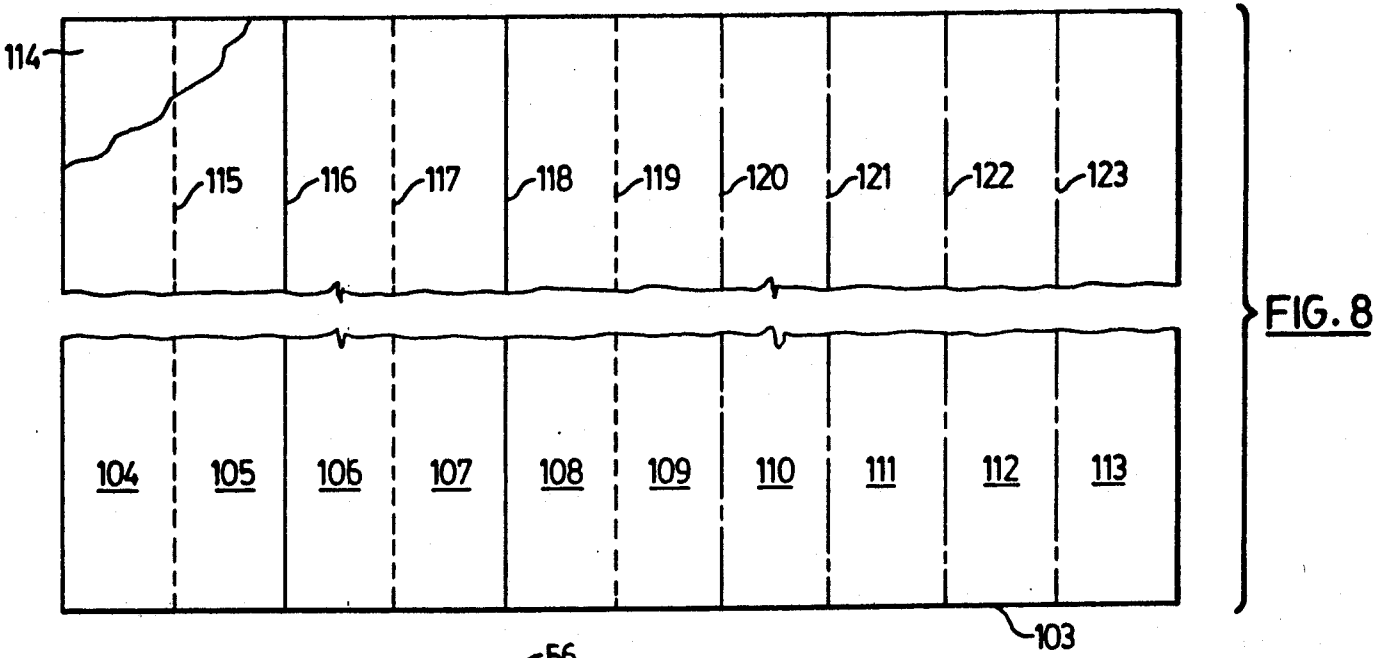
FIG. 8 is a plan view of a sheet of material foldable to form each of the crossbraces of the pallet of FIG. 7.

A second alternate embodiment of the invention is shown in FIGS. 7 to 11 inclusive in which a pallet 101 has a plurality of transverse reinforcing members or crossbraces 102 are located beneath platform 12 intermediate its end edges 30. Crossbraces 102 are each formed from a sheet 103 of stiff, foldable material divided as shown in FIG. 8 preferably into ten parallel panels 104 to 113 inclusive by score lines 115 to 123 as follows:

lines 115, 117, 119—reverse slit scoring (cut through one or more layers on reverse side and creased, shown by broken lines);

lines 116 and 118—slit scoring (cut through one or more layers and creased, shown by solid lines);

lines 120 to 123—scoring (creased, shown by chain dotted lines).

Figure 9:
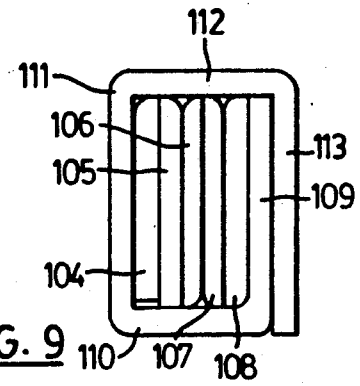
FIG. 9 is a cross-sectional view of one of the crossbraces of the pallet of FIG. 7.

For increased strength, corrugations 114 are preferably aligned normal to score lines 115 to 123. As seen in FIG. 9, panels 104 to 109 are folded along lines 115 to 119 in back-to-back relationship and panels 110 to 113 are folded along lines 116 to 123 to circumscribe folded panels 104 to 109. If desired, sheet 103 may be completely severed along one or more score lines 115 to 123 or each crossbrace 102 may be built up entirely of separate panels.

Figure 11:
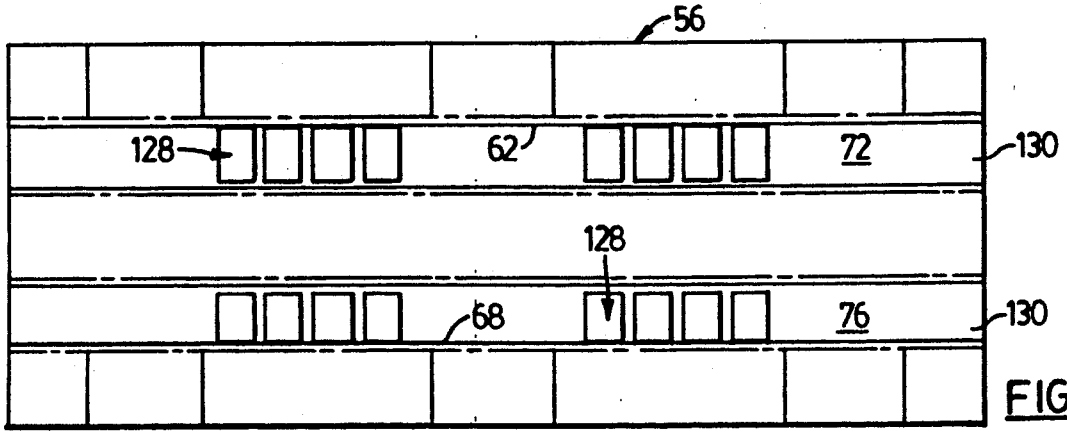
FIG. 11 is a plan view of a sheet of material foldable to form the central support of the panel of FIG. 7.
Figure 10:
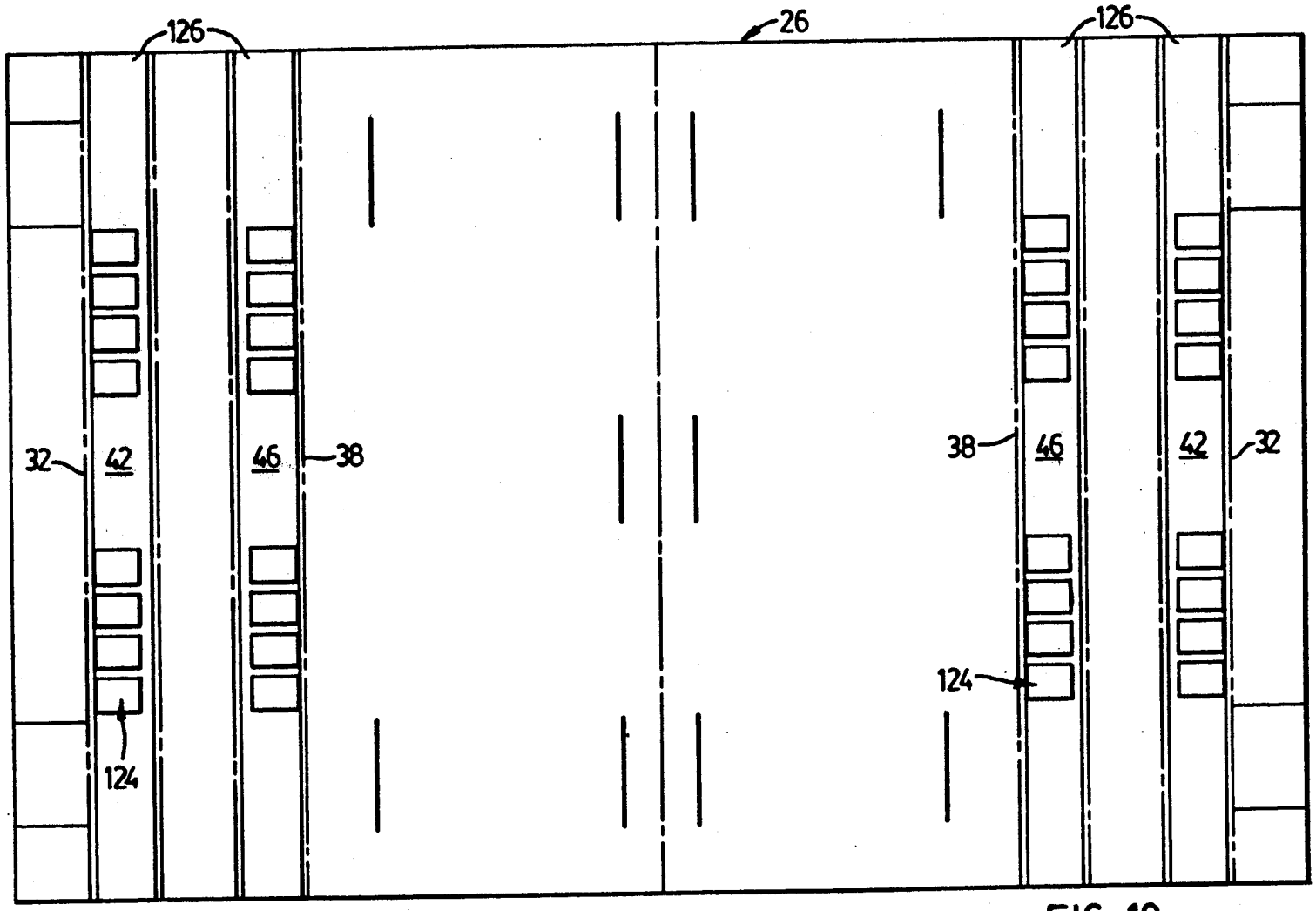
FIG. 10 is a plan view of a sheet of material foldable to form the basic structure of the pallet of FIG. 7.

To accommodate crossbraces 102, rectangular apertures 124 are suitably located in panels 42 and 44 of sheet 26 adjacent fold lines 32 and 38. Each panel 42 and 46 also carries a reinforcing strip 126, preferably of the same material as sheet 26, fixed to the panel, as seen in FIG. 10. Similar apertures 128 are located in panels 72 and 76 of sheet 56 adjacent fold lines 62 and 68, and panels 72 and 76 also carry reinforcing strips 130, as seen in FIG. 11. In this embodiment apertures 57 in panels 42 and 44 of sheet 26, and apertures 83 in panels 72 and 76 of sheet 56 are not present.

The assembled structure of the second alternate embodiment is shown in FIG. 7. Crossbraces 102 lie in groups between reinforcing members 24 and adjacent the underside of platform 12, passing through apertures 124 of outer channel members 18 and apertures 128 of central channel member 22, and having their ends preferably flush with the outer face of each of the outer channel members. It is preferable to have apertures 124 lie along fold line 32 between tabs 55 and to have apertures 128 lie along fold lines 62,68 between tabs 82.

Figure 3:
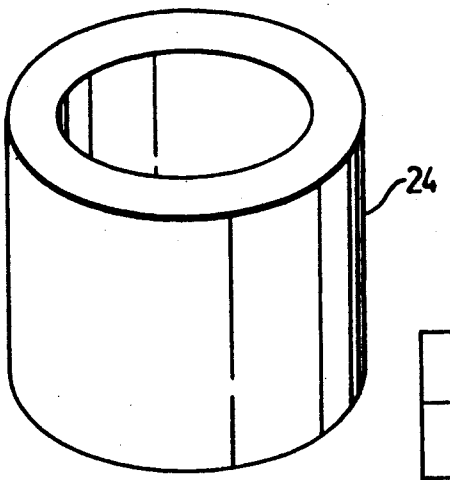
FIG. 3 is a perspective view of one of the reinforcing cores shown in FIGS. 1 and 2.

Reinforcing members 24 are preferably tubular cores cut from paper rolls as shown in FIG. 3. Reinforcing members 24 fit into channel members 18 to abut panels 40 and 44 and fit into channel member 22 to abut sheet 26 and panel 74, being preferably secured by glue where they abut.

It will be appreciated that the pallet of the invention is lightweight but strong. Also the pallet may be fabricated solely from paper products with no plastic or metal fasteners, thus making it easily recyclable which is a feature increasingly demanded by purchasers of this product.

The material of sheets 26, 56 and 102 is preferably corrugated cardboard, as mentioned above. A suitable type is A, B, C, E or jumbo flute, which may be used in any combination if the sheets are laminated and added strength is obtained by having the laminations in a cross-corrugated pattern. In addition, combinations of double wall, triple wall or quadruple wall corrugated cardboard may be used in any combination with itself or with a single wall. To increase the resistance to moisture and the elements, the sheet material forming the pallet may be constructed of wet strength or water resistant adhesives and/or wet strength or weather resistant liners, and may be constructed of fully hydrochem mediums.

It will be appreciated that apertures 57 and 83 in channel members 18 and 22 are not essential but provide a four-way entry into pallet 10 or 90. Apertures 57 and 83 may be perforated and may be knocked out by a user at his option.

The structure of the invention is not restricted to three stringers or channel members as shown in the example embodiment since more than one channel member 22 may be attached to sheet 26. Also, channel members 16 need not be square in cross-section as shown in the example embodiments, and the number of tabs 55 and 82 may vary, and the number of cores 24 may vary.

I claim:

1. A pallet comprising:

a first rectangular sheet of stiff, foldable material having opposed side and end edges and having a central portion and opposed side edge portions, the central portion having a top and bottom surface, the side edge portions each being folded into a plurality of parallel panels to form rectangular first and second channel members beneath the bottom surface of the central portion forming a platform, the outermost panels of the sheet being provided with transverse slits such that each of said outermost panels has at least one first tab and at least one second tab, the central portion having a plurality of first slots located in two spaced rows, the first slots being suitable to receive the first tabs, the at least one first tab of each outer panel being inserted through the first slots of one of said rows of first slots and folded to overlay a portion of the central portion top surface of the first sheet and being secured thereto, the at least one second tab of each outermost panel being folded to underlie the bottom surface of the central portion and being secured thereto, the at least one first and at least one second tab of the outermost panels forming an array of tabs alternately overlaying and underlaying the central portion respectively;

at least one second rectangular sheet of stiff, foldable material folded into a plurality of parallel panels to form at least a third rectangular channel member with the outermost panels extending laterally from said at least a third rectangular channel member and being provided with transverse slits to provide a plurality of third tabs, the central portion of the first sheet having a plurality of second slots located between the two rows of the first slots to receive the third tabs, the third tabs being inserted through the second slots of the first sheet and folded to overlay a portion of the central portion of the first sheet and being secured thereto; and the channel members for receiving vertical reinforcement means.

2. A pallet is claimed in claim 1 in which the material is corrugated cardboard.

3. A pallet as claimed in claim 1 including vertical reinforcement means received by said channel member, said vertical reinforcement means comprising a plurality of vertically oriented tubular cores.

4. A pallet as claimed in claim 1 in which all the panels are of equal width.

5. A pallet as claimed in claim 1 in which a single third channel member is secured to the first sheet in a centrally disposed position between the first and second channel members.

6. A pallet as claimed in claim 1 in which the outermost panels of the channel members are secured to the sheet.

7. A pallet as claimed in claim 1 in which the tabs are secured to the sheet by gluing.

8. A pallet as claimed in claim 1 in which the tabs and the outermost panels are secured to the sheet by gluing.

9. A pallet as claimed in claim 1 in which the first sheet is laminar having an upper rectangular lamina with opposed sides and ends, the opposed sides of the upper lamina being folded to form the first and second channel members, and a lower rectangular lamina with opposed sides and ends, the lower lamina extending outwardly at each opposed end beyond the opposed ends of the upper lamina and folded over the upper lamina and secured thereto.

10. A pallet as claimed in claim 9 in which the first sheet is corrugated cardboard and the lamina are arranged in a cross-corrugated pattern.

11. A pallet as claimed in claim 1 including at least two apertures in each of the channel members forming at least a pair of lateral passages extending through all the channel members normal thereto.

12. A pallet as claimed in claim 1 including a plurality of crossbraces, each crossbrace comprising a plurality of elongated panels lying face to face, the channel members each having apertures adjacent the platform forming lateral passages to receive the crossbraces.

13. A pallet as recited in claim 12, each crossbrace comprising a rectangular sheet of stiff material folded to form the panels of the crossbrace.

14. A pallet as claimed in claim 13 in which those panels adjacent one end of the sheet forming each crossbrace is to circumscribe the remaining panels of the crossbrace.

15. A pallet as claimed in claim 1 in which the first and second rectangular sheets each carry reinforcing strips fixed to those panels forming the upright sides of the channel members.

16. A pallet as claimed in claim 1 wherein the transverse slits of said at least one second rectangular sheet forms fourth tabs as well as said third tabs, said fourth tabs of said at least one second sheet being folded to underlay the bottom surface of the central portion and being secured thereto, the third and fourth tabs forming an array of tabs alternately overlaying and underlaying the central portion respectively.

17. A pallet as claimed in claim 1 wherein the at least one first tab associated with said first channel member extends oppositely to the direction in which the at least one second tab of said first channel member extends and wherein said at least one first tab associated with said second channel member extends oppositely to the direction in which said at least one second tab of said second channel member extends.

* * * * *